United States Patent [19]

Rusbach

[11] 4,212,245

[45] Jul. 15, 1980

[54] BOTTOM FUSE

[75] Inventor: Maurice Rusbach, Vaud, Switzerland

[73] Assignee: Sarmac S.A., Geneva, Switzerland

[21] Appl. No.: 959,191

[22] Filed: Nov. 7, 1978

[30] Foreign Application Priority Data

Dec. 2, 1977 [CH] Switzerland ..... 14765/77

[51] Int. Cl.[2] ..... F42C 15/24

[52] U.S. Cl. ..... 102/249; 102/253

[58] Field of Search ..... 102/248, 249, 247, 253, 102/274, 232, 233

[56] References Cited

U.S. PATENT DOCUMENTS

| | | | |
|---|---|---|---|
| 2,595,757 | 5/1952 | Brandt | 102/249 |
| 2,666,390 | 1/1954 | Brandt | 102/248 |
| 2,845,866 | 8/1958 | Jasse | 102/253 |
| 3,858,515 | 1/1975 | Rusbach | 102/248 X |

FOREIGN PATENT DOCUMENTS

| | | | |
|---|---|---|---|
| 522073 | 10/1955 | Belgium . | |
| 527350 | 10/1921 | France . | |
| 1068411 | 6/1954 | France . | |
| 127622 | 6/1919 | United Kingdom | 102/253 |
| 927023 | 5/1963 | United Kingdom | 102/253 |

*Primary Examiner*—David H. Brown

*Attorney, Agent, or Firm*—Young & Thompson

[57] ABSTRACT

The invention relates to a bottom fuse for an explosive projectile for example a rifle grenade comprising a hollow revolution body the rear end of which is provided either with a primer or with a percussion point and inside of which a detonator is slidably mounted. The detonator is movable from an inactive stocking position completely inside said body to an active working position partly outside of said body, and means are provided for locking the detonator in stocking position. A sleeve is further slidably mounted outside of said body and is subjected to a resilient action and to the action of delay means of its forward motion under the effect of said resilient action. Finally a percussion point carrier or a primer carrier is slidably mounted outside of the rear end of said hollow revolution body and is subjected to a resilient action intended to maintain the percussion point away from the primer.

7 Claims, 11 Drawing Figures

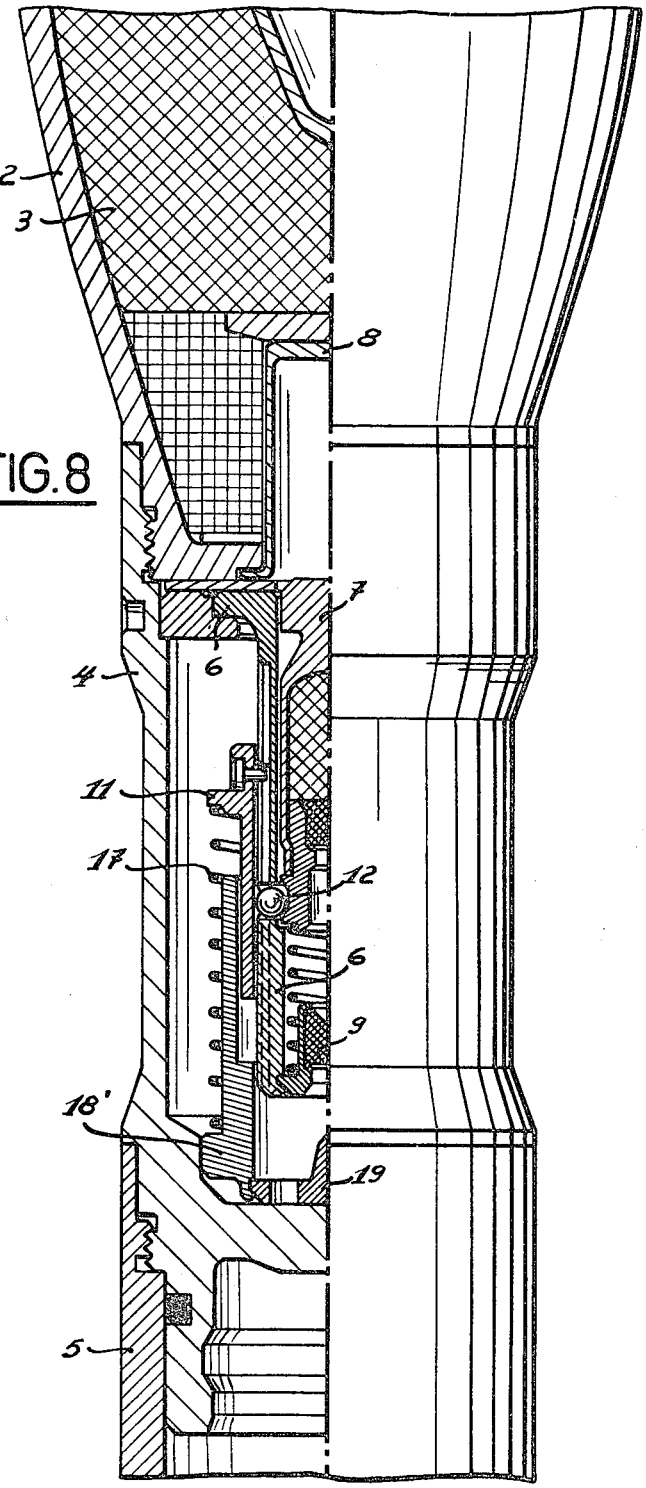
FIG.8
FIG.9
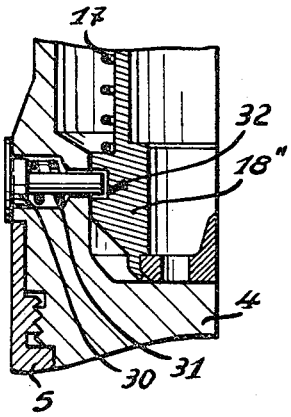

BOTTOM FUSE

The present invention relates to a bottom fuse actuated by inertia, comprising a detonator outside of the charge and intended to equip more particularly low speed explosive projectiles such as rifle grenades (anti-personal, fragmentation, perforating, with hollow charge, smoke producing, incendiary, etc.).

The object of this invention consists therefore in a bottom fuse for an explosive projectile, characterized by the fact that it comprises a hollow revolution body, the rear end of which is provided with a primer or a percussion point and within which a detonator is slidably mounted, by the fact that this detonator is movable from an inactive stocking position completely inside said body to an active working position partly outside of said body, by the fact that it comprises further means for locking said detonator in said stocking position, a sleeve slidably mounted outside of said body and subjected to a resilient action and to the action of delay means of its motion forward under the effect of said resilient action, and a percussion point carrier or a primer-carrier slidably mounted outside of the rear end of said hollow revolution body and subjected to a resilient action intended for maintaining said percussion point away from said primer.

The annexed drawings illustrate schematically and by way of example several embodiments of the bottom fuse according to the invention.

FIGS. 7 to 10 illustrate other embodiments of the bottom fuse.

Figure 2:
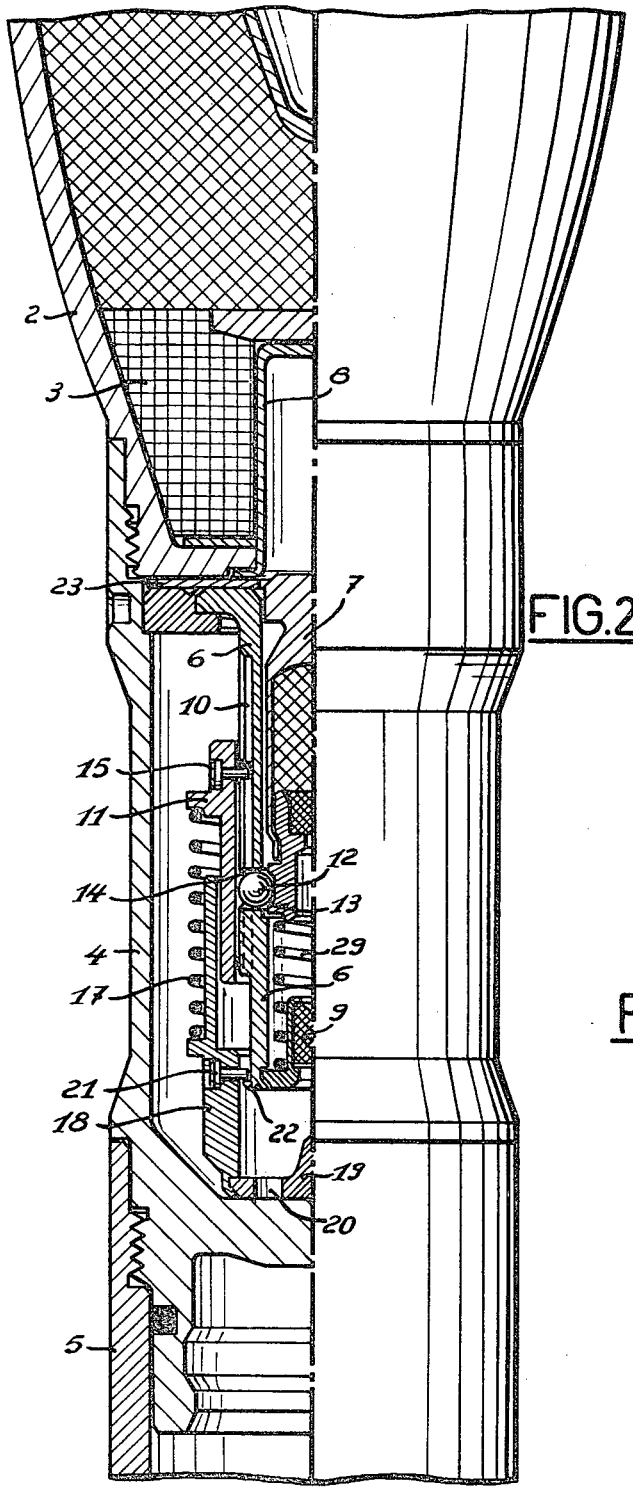
FIG. 2 is a partly sectional view of a bottom fuse of the rifle grenade according to FIG. 1, in stocking position.
Figure 1:
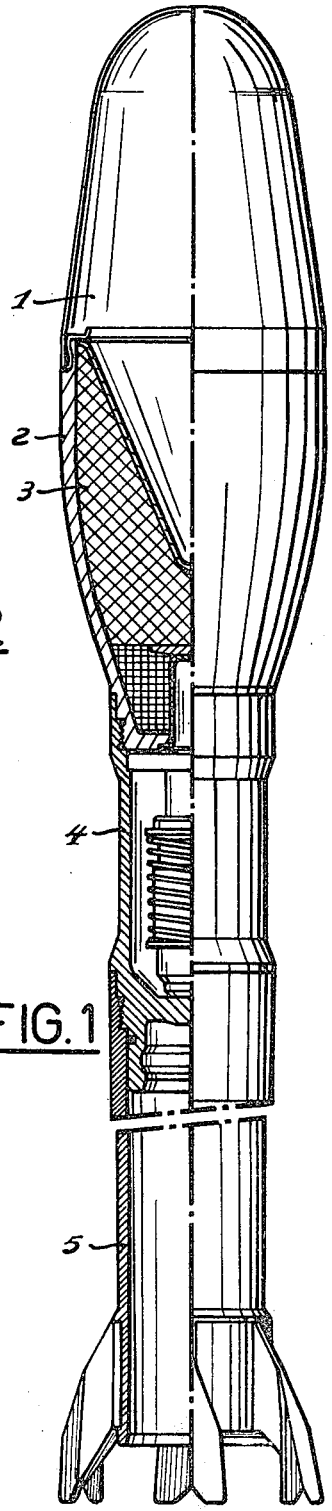
FIG. 1 is a partly sectional general view of a rifle grenade.
Figure 3:
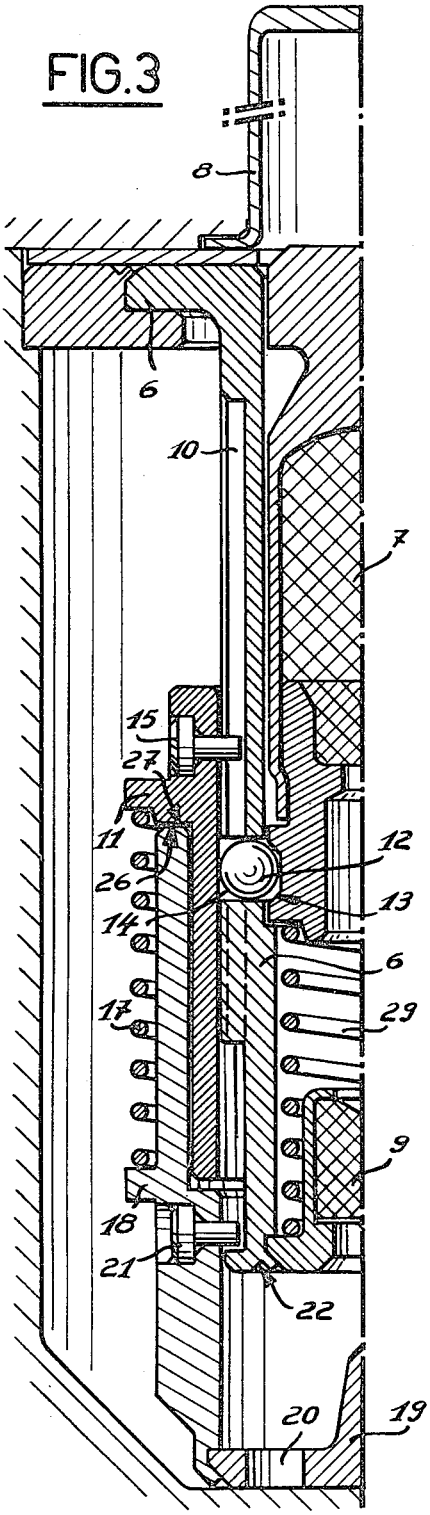
FIGS. 3 to 5 illustrate the working of the fuse according to FIG. 2, respectively the arming, armed and percussion positions.
Figure 4:
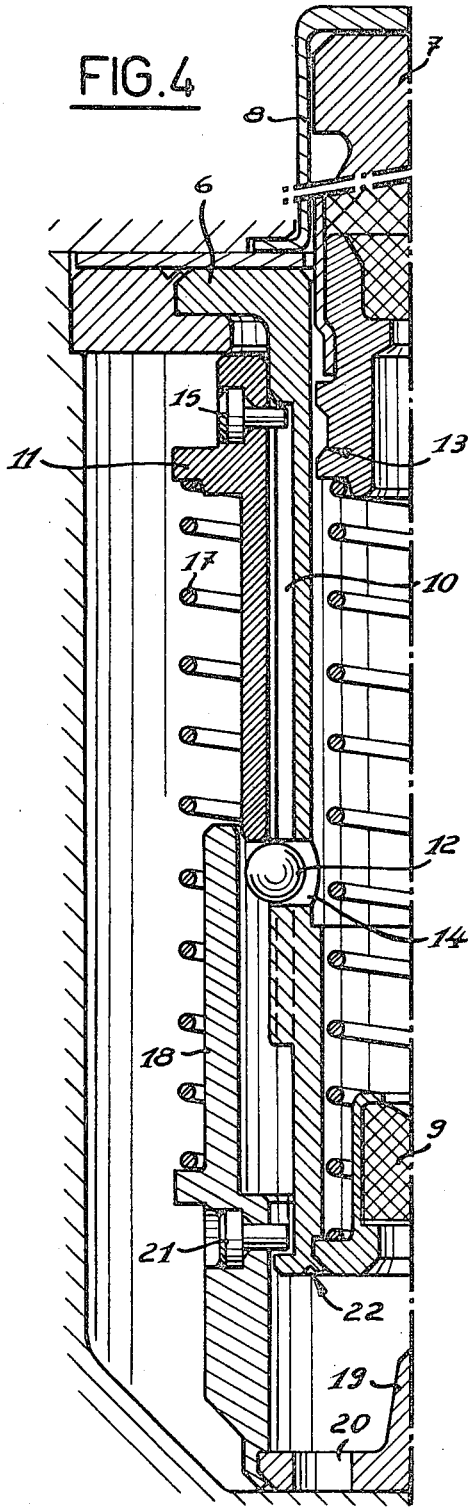

The rifle grenade as illustrated by way of example in FIGS. 1 and 2 comprises a head 1 with a bottom 2 including an explosive charge 3, an intermediate body 4 and a tail 5.

The whole of the fuse contained in the intermediate body 4 is arranged around a cylindrical fixed piece which is in fact the primer carrier 6, inside which the detonator 7 is slidably mounted, outside of the charge in the stocking position shown in FIG. 2, and intended to be lodged, in working position, in a sheath 8 provided in the charge 3.

The primer carrier body 6 comprises at its rear end a primer 9 secured by crimping and presenting on its external face two milled recesses 10, diametrically opposite in order to balance the stresses by making them symmetrical. These recesses 10 are intended to maintain a sleeve 11 in position and to insure the time delay necessary for muzzle security, in other words the delay of the arming.

Figure 11:
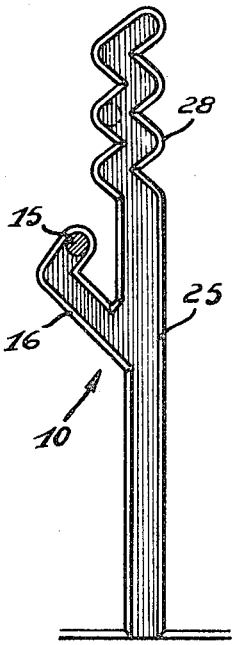
FIG. 11 is a sectional view of a milled recess used to delay the arming.

In the stocking position (FIG. 2), the detonator 7 is maintained outside of the charge by a ball 12 partly engaged in a groove 13 of the detonator 7. This ball 12 emerges from a conduit 14 of the primer carrier 6, and is maintained in this conduit 14 by the boring of the sleeve 11. This latter is maintained in locking position of the ball 12 by two pins 15 diametrically opposite and cooperating with the recesses 10, and more particularly in this position with the keeping branches 16 of said recesses under the action of a spring 17 (see also FIG. 11 for the detail of a recess 10).

A percussion point carrier 18 is maintained in abutment against the bottom of the intermediary body 4 by the push of the spring 17 abutting against the sleeve 11, which is itself in abutment on the other side by its pins 15 engaged as described above in the recesses 10. The percussion body 19 crimped on the percussion point carrier 18 comprises holes 20 for the passage of the air in order to avoid a so-called "dash-pot" slackening effect during its motion to percuss the primer 9. In this embodiment, the percussion point carrier 18 comprises a pin 21 intended to facilitate the assembling of the fuse.

As a matter of fact, the percussion point carrier 18, being pushed back by the spring 17, it is difficult to introduce the whole on such a length without any risk of disassembling. In order to obviate to this drawback, during the assembling of the percussion point carrier 18, the pin 21 passes through a milling of the flange 22 of the primer carrier 6; then, a rotation of a fraction of a turn of the percussion point carrier 18 insures its locking by the abutment of the pin 21 against the flange 22.

The device is completed by a disk 23 made of a semi-rigid material which insures the rigidity of the assembling and the locking of the intermediate body 4 on the body of the grenade 3.

According to another embodiment (not shown), the respective positions of the primer and of the percussion point can be inverted, the percussion point with its point directed to the rear end being interdependent with the rear end of the fixed piece and the primer being thus fixed to a movable element corresponding to the percussion point carrier of the embodiment described above.

Figure 7:
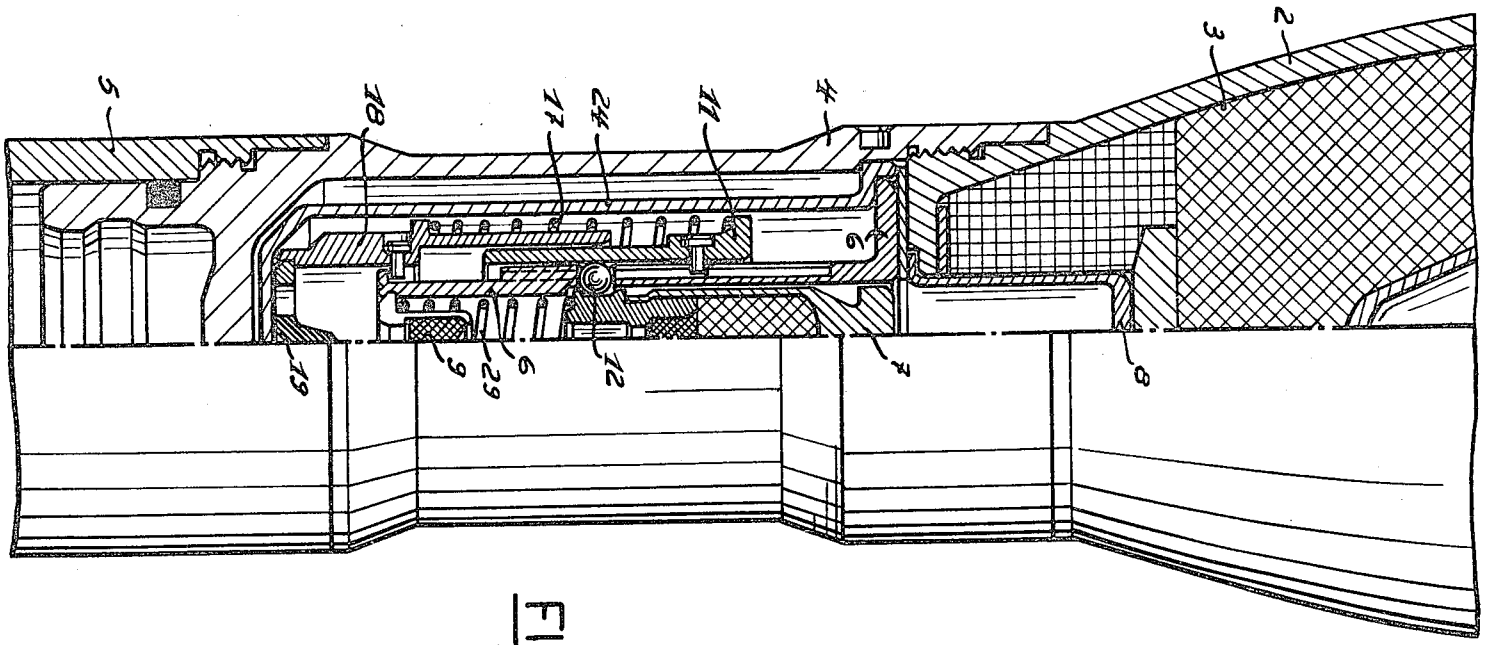

According to another embodiment, the whole of the fuse, that is the elements contained in the intermediate body 4 according to FIG. 2, can be included in a casing 24, as shown on FIG. 7, crimped on the primer carrier 6 inside of said intermediate body 4. This presents the advantage of making the fuse independent and thus enabling one to stock it and to transport it apart.

The working of the fuse will be now described by reference to FIGS. 3 to 6. At the start of the shot (see FIG. 3), the sleeve 11 plunges under the effect of inertia thus compressing the spring 17 and following through its pins 15 the path of the branches 16 of the recesses 10 (see details on FIG. 11) which give access to the rectilinear parts 25 of said recesses. This plunging path being ended, and the shoulder 26 of the sleeve 11 being thus brought into abutment against the edge 27 of the percussion point carrier 18, the sleeve 11 is thrown forward by the spring 17.

During this forward movement, the sleeve 11 is guided by its pins 15 first in the rectilinear parts 25 of the recesses 10, and then by the zigzag parts 28 (see FIG. 11), the purpose of said zigzag parts being to provide a delay to the arming, and thus to insure muzzle security. At the end of the path of the sleeve 11, the conduit 14 is uncovered, thus allowing to the ball 12 to emerge from said conduit; this ball 12 is than pushed out by the slope of the circular groove 13 under the action of the spring 29, which will then push the detonator 7 thus unlocked into the sheath 8 into active position inside the charge 3, the device being thus in its armed position shown on FIG. 4.

Figure 5:
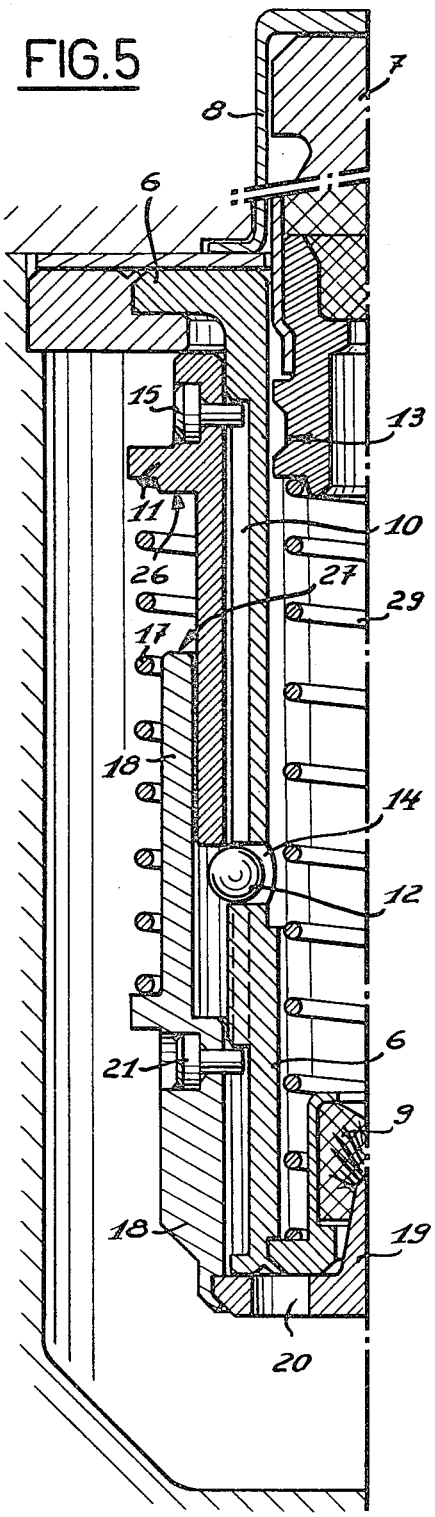

At the time of the impact, the projectile is slowed down and the primer 9 which is carried by the primer carrier 6 comes under the same slowing down action. At the same time, the percussion point carrier 18 which is now free in rectilinear translation continues its motion and the percussion point 19 strikes the primer 9, the explosion of which causes the explosion of the detonator 7, and thus of the explosive charge, as shown in FIG. 5. The release of the percussion point carrier 18 is obtained by the fact that, in armed position, the shoulder 26 of the sleeve 11 having advanced, it is no longer opposed as an abutment against the edge 27 of the percussion point carrier 18, and the percussion point 19 is then able to percuss the primer 9.

Furthermore, the distance between pieces 11 and 18 determines an important elongation of the spring 17, which tends to decrease the opposition to the motion of the percussion point carrier 18 towards the fore part, that is towards the primer 9. The sensitivity of the fuse is further increased by the higher density of the percussion point carrier 18 and of percussion point 19, which are preferably made of steel.

The muzzle security, which consists in preventing the explosion of the grenade for a certain security distance in front of the marksman, is realized in the two following manners: first by delaying the arming, that is by the forward and backward motion of sleeve 11, and then by the temporizing action of the recesses, which delay during the beginning of the flight the advance of the detonator 7 into the charge 3, this allowing the projectile to cover the security distance before being armed. The detonator 7 is unlocked only at the end of the stroke of the sleeve 11, after a time delay caused by the forward and backward motion of said sleeve added to the braking action of the recesses.

In case of premature impact inside this security distance, and from the moment when the sleeve 11 no longer opposes its shoulder 26 in abutment to the edge 27 of the percussion point carrier 18, the detonator 7 explodes in a position outside of the charge inside the intermediate body 4, this being thus without any effect on the charge itself. Furthermore, the bottom of the detonator 7 constitutes a shield machined in such a manner that it takes under the effect of the explosion a tulip shape, in order to increase the protection of the charge at the opening of the sheath 8.

Figure 6:
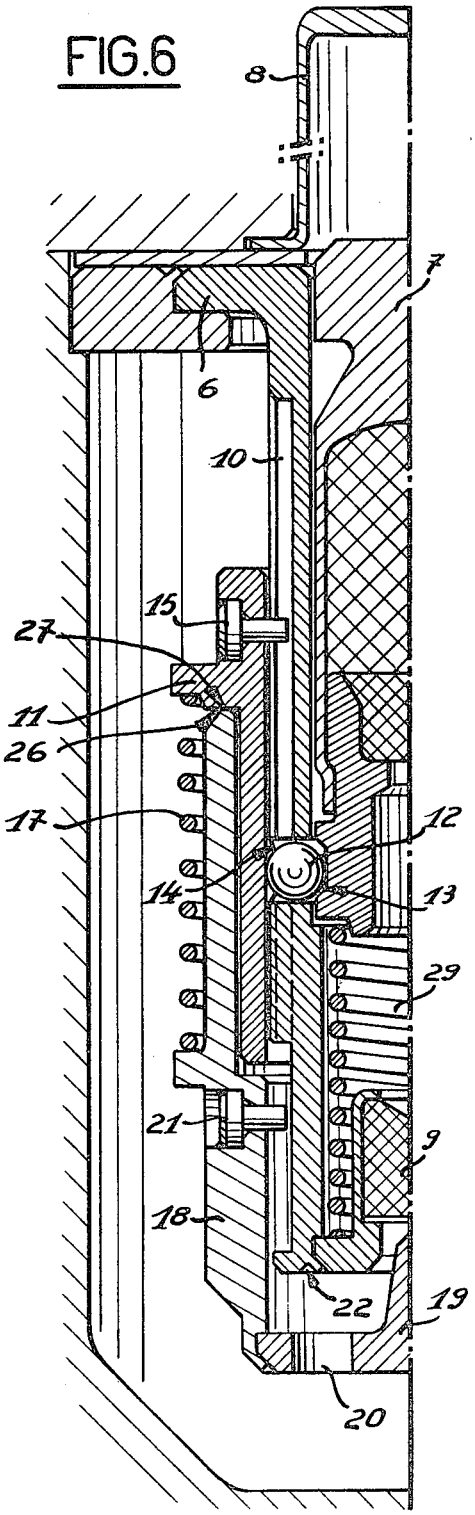
FIG. 6 illustrates the principle of the fall security of such fuse.

The fall security is obtained, as shown in FIG. 6, by the fact that in its forward motion by inertia, the percussion point carrier 18 compresses first the spring 17 and comes into abutment by its edge 27 against the shoulder 26 of the sleeve 11 which is itself locked; this conduces, due to the respective dimensions of these pieces, to stop the percussion point 19 at a certain distance from the primer 9 (security distance). Consequently, in case of dropping on the head of the fuse, the primer 9 cannot be percussed by the percussion point 19.

FIGS. 8 and 9 illustrate other embodiments in which the percussion point carrier 18', respectively 18'', is either mounted without the presence of a pin 21 as in FIG. 2, or can be locked in stocking position by a pin 30 passing through a transverse opening 31 provided in the intermediate body 4 and cooperating with a groove 32 of said percussion point carrier 18''.

Figure 10:
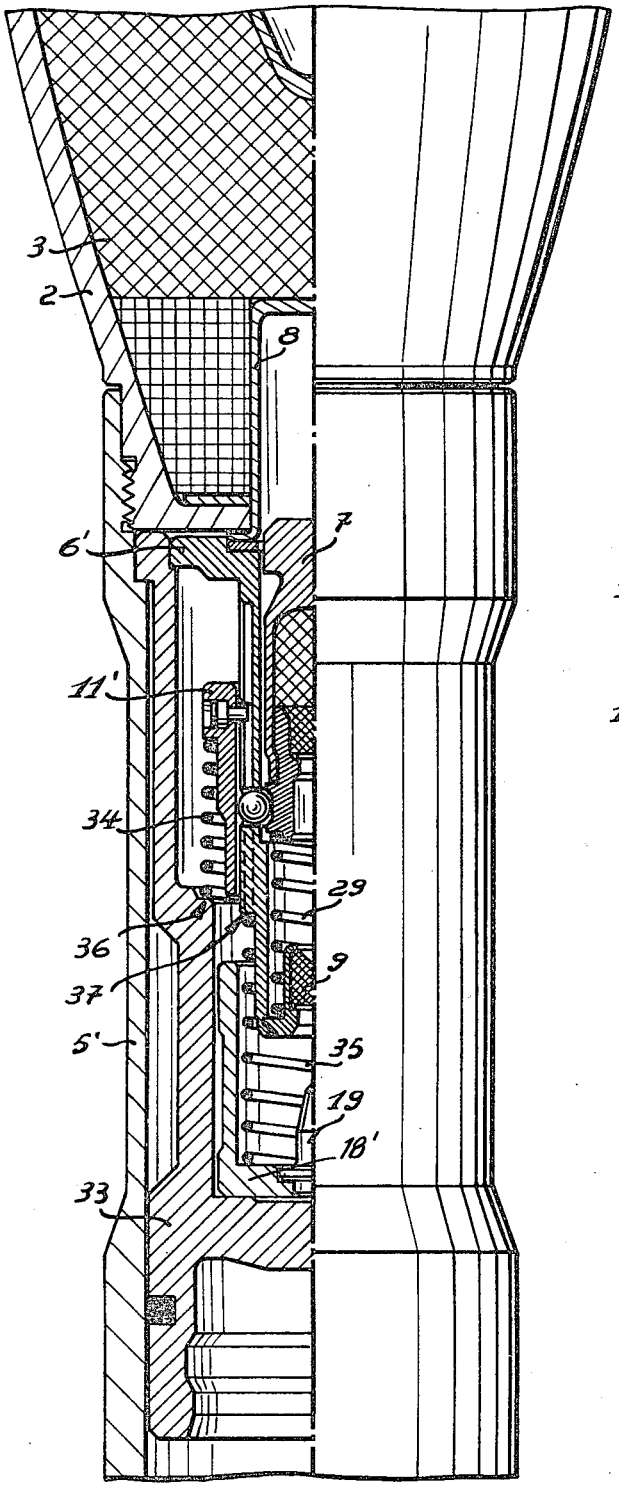

Finally, FIG. 10 illustrates an embodiment which is substantially different from those already described. As a matter of fact, the tail 5' is directly screwed on the bottom 3, and the fore part of said tail comprises a casing 33, which itself contains the different pieces of the fuse, and which is crimped in position by the primer carrier 6'. Furthermore, in this embodiment, the sleeve 11' and the percussion point carrier 18' are each subjected to the action of a spring, respectively 34 and 35, the lower end of the spring 34 being in abutment against a shoulder 36 of the casing 33 and the upper end of the spring 35 being in abutment against a shoulder 37 of the rear part of the primer carrier 6'. The working of this embodiment is similar to the one already described.

The basic principle of this invention consists therefore in providing means allowing the instantaneous unlocking of the percussion point carrier or of the primer carrier at the start of the shot, while delaying the release of the movable detonator in order to about its destruction outside of the charge in case of an unexpected obstacle near the marksman. The handling security is consequently also insured.

Of course, other locking means and other delay devices than those described above by way of examples can be also used in the projectile according to the invention.

The bottom fuse for an explosive projectile according to the invention presents several advantages, among which can be noted a very simple construction implying a very few number of pieces assembled according to an axial system and insuring however all the required security, reduced dimensions and weight, as well as the fact that it is removable and stockable apart of the other parts of the projectile.

While the invention has been described in detail and with reference to specific embodiments thereof, it will be apparent to one skilled in the art that various changes and modifications can be made therein without departing from the spirit and scope thereof.

What I claim is:

1. Bottom fuse for an explosive projectile, comprising a hollow body, a primer and a percussion point at the rear of the hollow body, a detonator mounted for forward sliding movement in the hollow body from an inactive stocking position completely inside the body to an active working position partly outside the front of said body, means for releasably locking the detonator in said stocking position, a sleeve slidably mounted outside said body, means resiliently urging the sleeve forwardly toward a foward position in which said sleeve unlocks said locking means, means to delay said forward movement of said sleeve under the influence of said urging means, and means resiliently urging said percussion point and primer away from each other.

2. Bottom fuse according to claim 1, in which said locking means comprises a ball partly engaged in a groove in said detonator and emerging from an opening provided through said body to unlock the detonator when said sleeve is in a forward position.

3. Bottom fuse according to claim 1, in which said delay means comprises a recess in said body having a non-rectilinear path, and a projection carried by said sleeve and movable in said recess to delay forward movement of said sleeve.

4. Bottom fuse according to claim 1, and a spring disposed within said body and urging said detonator forwardly.

5. Bottom fuse according to claim 1, in which one of said primer and percussion point is mounted on the rear of said body and the other of said primer and percussion point is carried by a further sleeve slidable on said body, and a spring urging said further sleeve rearwardly relative to said body.

6. Bottom fuse according to claim 5, in which said spring acts between the first-mentioned sleeve and said further sleeve.

7. Bottom fuse according to claim 5, in which the first-mentioned sleeve and further sleeve abut each other in a rearward position of said first-mentioned sleeve, thereby to prevent contact between said primer and percussion point prior to the time said first-mentioned sleeve has advanced to its forward position.

* * * * *